United States Patent [19]

Dinner

[11] Patent Number: 4,654,921

[45] Date of Patent: Apr. 7, 1987

[54] TOOTHBRUSHES

[76] Inventor: Mark E. W. Dinner, 27 Twain Cir., R.D. #1, Sugarloaf, Pa. 18249

[21] Appl. No.: 820,423

[22] Filed: Jan. 16, 1986

Related U.S. Application Data

[63] Continuation of Ser. No. 660,783, Oct. 17, 1984, abandoned.

[51] Int. Cl.[4] ..... A46B 5/00

[52] U.S. Cl. ..... 15/167 R; D4/110; 15/143 R

[58] Field of Search ..... 15/167 R, 143 R; 128/359, 360, 62 A, 67; D4/18; D24/10, 11

[56] References Cited

U.S. PATENT DOCUMENTS

| | | | |
|---|---|---|---|
| D. 122,815 | 10/1940 | Crosby | D4/18 |
| 2,273,207 | 2/1942 | Kuhn | 15/167 R |
| 3,214,776 | 11/1965 | Bercovitz | 15/167 R |

*Primary Examiner*—Timothy F. Simone
*Attorney, Agent, or Firm*—Louis E. Marn

[57] ABSTRACT

A toothbrush comprised of a handle including an oval ring that defines an oval aperture sized for the passage therethrough of a young child's or infant's four fingers for fist gripping a half portion of the oval ring; and a brush head including an array of bristles that extends in general alignment with the major axis of the oval ring.

1 Claim, 4 Drawing Figures

TOOTHBRUSHES

This is a continuation, of application Ser. No. 660,783, filed Oct. 17, 1984, abandoned.

FIELD OF INVENTION

This invention relates to toothbrushes, and more particularly, to toothbrushes sized and shaped for efficient and safe handling by young children and infants.

BACKGROUND OF THE INVENTION

The employment of toothbrushes by children and adults to achieve a high standard of dental care is dependent upon such individuals properly brushing their teeth on preferably a daily basis. The hygenic need for brushing ones teeth is uniformly accepted. However, such need is not generally viewed as applicable to young children and infants experiencing teething or initial eruptions of first or baby teeth. Often, such young children and infants are unable, because of their small hands of limited strength and manual dexterity, to hold and manipulate currently available toothbrushes. Though a young child's teeth are not permanent, good oral hygiene commands the removal of tooth plaque, and a high degree of mouth cleanliness for the avoidance of tooth decay.

The present invention permits a young child or infant to properly hold and manipulate an infant-sized toothbrush without any special training. More particularly, the instant invention takes cognizance of the natural tendency of infants to place objects in their mouths, in providing a toothbrush that has a handle of a shape that permits an infant to easily manipulate same, while maintaining a proper alignment of the toothbrush head in a tooth brushing sequence.

OBJECTS OF THE INVENTION

An object of the invention is to provide a novel toothbrush that is comprised of a handle including an oval shaped ring that permits a young child or infant to fist grip and manipulate same in a proper tooth brushing sequence.

Another object of the invention is to provide a novel toothbrush sized and shaped for enabling safe and effective use thereof.

Still another object of the present invention is to provide a novel toothbrush for use by a young infant without training.

SUMMARY OF THE INVENTION

These and other objects of the present invention are achieved by a toothbrush comprised of a handle including an oval ring that defines an oval aperture sized for the passage therethrough of a young child's or infant's four fingers for fist gripping a half portion of the oval ring; and a brush head including an array of bristles that extends in general alignment with the major axis of the oval ring.

Figure 1:
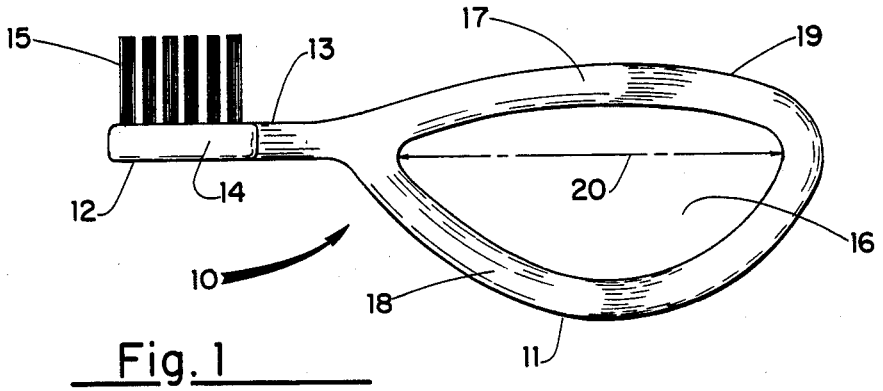
FIG. 1 is a side elevational view of a toothbrush in accordance with the instant invention.
Figure 2:
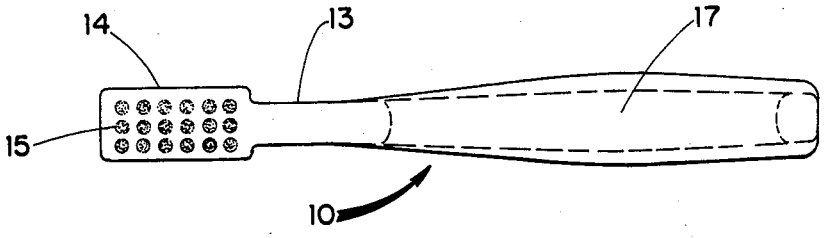
FIG. 2 is a top plan view of the toothbrush illustrated in FIG. 1.
Figure 3:
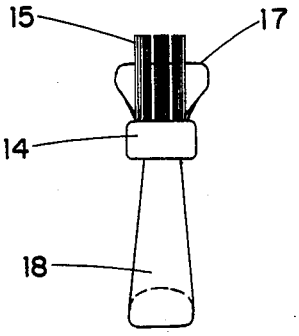
FIG. 3 is a front elevational view of the toothbrush illustrated in FIG. 1.
Figure 4:
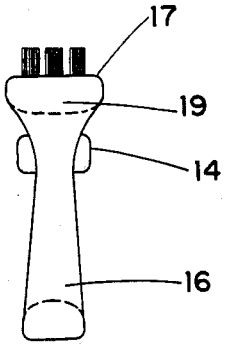
FIG. 4 is a back elevational view of the toothbrush illustrated in FIG. 1.

Referring now to the drawing, there is illustrated a toothbrush of the present invention, generally indicated as 10, comprised of a handle 11 and a brush head 12. The brush head 12 is comprised of bristle support member 14 and an array of bristles 15. The handle 11 and the bristle support member 14 are of preferably unitary construction and comprised of a conventional moldable resilient plastic composition. Further, the handle 11 includes an oval ring 19 whose size is proportioned to the size of a small hand of a young child or infant. Adjacent the forward end of the oval ring 19 is a bridge member 13 which is formed as an integral part of the handle 11 and serves to support the brush head 12 in a manner wherein the array of bristles 15 is in general alignment with a major axis 20 of the oval ring 19. The dimensions of the toothbrush 10 are proportioned to permit a young child or infant to hold the oval ring 19 within the grip of the child's fist, by the passage of the child's four fingers over an upper half 17 of the oval ring 19, and through an oval aperture 16 defined within the oval ring 19; and the closure of the child's thumb about the exterior of the upper half 17 of the oval ring 19 in the vicinity of the bridge member 13. To provide a natural means of selection, the cross sectional circumference of a lower half 18 of the oval ring 19 is preferably less than the cross sectional circumference of an upper half 17 of the oval ring 19, except in the area whereat such two halfs join together. This configuration of an oval ring 19 for the handle 11 has been found to require very little manual dexterity by the young child in fist gripping an upper half portion thereof as aforesaid noted; and manipulating same in a brushing sequence. Toothbrushes in accordance with the present invention have been employed efficiently, safely and enthusiastically by young children and infants. All exterior edges were rounded for safety and comfort reasons, with the array of bristles 15 comprised of soft nylon bristles.

While the invention herein has been described in connection with an exemplary embodiment thereof, it will be understood that many modifications will be apparent to those of ordinary skill in the art and that this application is intended to cover any adaptions or variations thereof. Therefore, it is manifestly intended that this invention be only limited to the claims and the equivalents thereof.

What is claimed is:

1. A toothbrush for young children and infants comprised of:

a handle of unitary rigid construction including an oval ring and a bridge member extending longitudinally from a forward end of said oval ring, said oval ring having an oval aperture therein having dimensions proportioned to permit a young child or infant to hold said oval ring within the grip of its four fingers over an upper half of said oval ring and through said oval aperture, and with its thumb closed about said upper half of said oval ring in the vicinity of said bridge member; said upper half of said oval ring having a cross-sectional circumference greater than the cross-sectional circumference of a lower half of said oval ring; and a brush head including a bristle support member extending longitudinally in a direction generally in alignment with a major axis of said oval ring, and an array of bristles supported by and extending from said bristle support member.

* * * * *